US005820802A

United States Patent [19]

Oberoi

[11] Patent Number: 5,820,802

[45] Date of Patent: Oct. 13, 1998

[54] TILE MAKING MACHINE AND METHOD

[75] Inventor: Bhushan Kumar Oberoi, Surrey, England

[73] Assignee: Redland Technologies Limited, England

[21] Appl. No.: 537,825

[22] PCT Filed: Apr. 28, 1994

[86] PCT No.: PCT/EP94/01443

§ 371 Date: Dec. 19, 1995

§ 102(e) Date: Dec. 19, 1995

[87] PCT Pub. No.: WO94/25235

PCT Pub. Date: Nov. 10, 1994

[30] Foreign Application Priority Data

Apr. 29, 1993 [GB] United Kingdom ..... 9308887

[51] Int. Cl.[6] ..... B28B 5/07; B28B 7/14; B28B 11/14

[52] U.S. Cl. ..... 264/145; 264/148; 264/163; 264/177.11; 264/211.11; 264/DIG. 31; 425/219; 425/220; 425/308; 425/310; 425/425; 425/434

[58] Field of Search ..... 264/145, 148, 264/DIG. 31, 163, 177.11, 211.11; 425/218–220, 296, 308, 310, 425, 434

[56] References Cited

U.S. PATENT DOCUMENTS

| | | | |
|---|---|---|---|
| 3,303,245 | 2/1967 | Trudeau | 264/145 |
| 3,776,075 | 12/1973 | Matthews | 264/145 |
| 4,666,648 | 5/1987 | Brittain | 264/145 |
| 4,856,395 | 8/1989 | Smith et al. | 264/145 |
| 5,075,985 | 12/1991 | Koch et al. | 264/145 |
| 5,080,840 | 1/1992 | Jost et al. | 264/145 |
| 5,223,200 | 6/1993 | Schulz et al. | 264/145 |
| 5,595,698 | 1/1997 | Nicholas et al. | 264/245 |

FOREIGN PATENT DOCUMENTS

| | | |
|---|---|---|
| 0035010 | 9/1981 | European Pat. Off. . |
| 1448574 | 9/1976 | United Kingdom . |
| 2183530 | 6/1987 | United Kingdom . |

*Primary Examiner*—Karen Aftergut

*Attorney, Agent, or Firm*—Rothwell, Figg, Ernst & Kurz, P.C.

[57] ABSTRACT

A roof tile making machine and its method of operation. The reinforcement ribs on the underside of a concrete roofing tile are formed during their manufacture by directing mortar into recesses in a pallet on which the tile is made, with a compactor means in the form of multi-tined wheels compacting the mortar in the recesses, and providing thereafter a secondary layer of mortar over the compacted reinforcement ribs, to complete the tile in a conventional manner. A tile provided by the apparatus of the invention has reinforcement ribs which are compacted to the same degree as the remainder of the tile, thereby ensuring that the finished product, when cured, has a uniform, or substantially uniform, strength.

17 Claims, 5 Drawing Sheets

TILE MAKING MACHINE AND METHOD

This invention is concerned with improvements in or relating to a roof tile making machine and its method of operation.

Concrete roof tiles are in the main formed by the well known roller and slipper method in which tile pallets are fed seriatim beneath the mortar hopper of a tile making machine, whereat when the machine is in use, mortar is fed onto the pallets to form a continuous ribbon thereon. Downstream of the mortar hopper, a cutting mechanism of the tile making machine is operated to cut the ribbon of mortar to form discrete "green state" tiles on the individual pallets which "green state" tiles are thereafter cured by conventional means.

The upper surfaces of the tiles so formed are generated by the roller and slipper and may therefore be of any desired profile across the tiles so formed. For example, the tiles may have a so-called "Bold Roll" or "Roman" profile.

The under-surfaces of the tiles, on the other hand, are formed by the pallets, that is, the surfaces of the pallets are shaped with recesses and channels to form hanging nibs, strengthening ribs and downwardly facing interlocking side-lock features of the tiles.

Often the strengthening ribs have a depth which is self-defeating in relation to their purposive intent which is to strengthen the tiles. Tests effected on cured tile sections have consistently indicated that the thin body sections have greater strength than the ribs or that size for size the proportion of the tile's strength supplied by the ribs is disproportionate to their depth. It is believed that this phenomenon is caused by the variations in compaction of the different sections of the tiles. For example, a thin body section is readily compacted to give a high strength for a particular cross-section and yet an adjacent strengthening rib formed under the same compacting pressures, applied by the same roller and slipper does not have the strength expected of it. Visual examination of the cross-section of such ribs by examination of the apparent porosity thereof has revealed that the compaction of the mortar is greatest towards the thin body portion of the tiles whilst it falls off towards the extremities of the ribs, that is the degree of compaction of the mortar in the ribs is apparently a function of the respective depths of the ribs.

The present invention seeks to overcome or at least mitigate the disadvantages of the prior art concrete roof tiles. Thus, the present invention provides a tile making machine comprising a hopper provided with a packshaft, roller and slipper, said packshaft being effective, when the machine is in use and tile pallets are fed seriatim beneath said hopper, to direct mortar onto said pallets as they pass beneath the roller and slipper to form a continuous ribbon of mortar on said pallets, characterised in that the tile making machine also comprises compaction means upstream of said packshaft, roller and slipper, which compaction means comprises a primary compaction device which, when the machine is in use and tile pallets are fed as aforesaid, directs and compacts mortar onto and/or into selected portions only of said pallets said selected portions forming, inter alia, longitudinal strengthening ribs in finished tiles.

The present invention also provides a tile making machine according to the preceding paragraph further characterised in that said compacting means also comprises a secondary compaction device wherein, when the machine is in use, and after the primary compaction device has directed and compacted mortar onto and/or into the selected portions of the pallets as aforesaid, the secondary compaction device further compacts the mortar in said selected portions only of the pallets as the pallets pass therebeneath to fully compact the mortar of the portions forming the longitudinal strengthening ribs in the finished tile as aforesaid.

Preferably in the tile making machine according to the last two preceding paragraphs, the primary compaction device comprises a multi-tined wheel arranged in use to overlie selected portions only of said pallets as aforesaid, the multi-tined wheel conveniently having an effective width corresponding to the width of the longitudinal strengthening ribs formed by said selected portions only of the pallets.

The present invention also provides a tile making machine according to the last two preceding paragraphs wherein the secondary compaction device comprises a thin gauge blade element extending parallel to the direction of feed of the pallets fed seriatim beneath said hopper, the blade element comprising a blade portion arranged to lie in or towards a nip portion provided in use of the tile making machine and formed between a circumferential path generated by the tines of the multi-tined wheel and co-planar upper surface portions of said pallets fed therebeneath.

Preferably in the tile making machine according to the last preceding paragraph said blade element has an effective length of 0.1 to 0.3 the length of tile pallets used therewith.

Conveniently in a tile making machine according to any one of the last four preceding paragraphs the compaction means is located in said hopper upstream of the packshaft, roller and slipper, as aforesaid.

Preferably in a tile making machine provided by the invention the compaction means may be located in a secondary hopper located upstream of said hopper.

The present invention also conveniently provides a process for the manufacture of concrete roof tiles in a conventional tile making machine provided with a hopper supporting a packshaft, a roller and a slipper all of known configuration, said process comprising the steps of :

a) supplying mortar to a compacting means located upstream of said packshaft, roller and slipper;

b) causing tile pallets to be fed seriatim beneath said compacting means whereat, when the process is being effected, mortar is directed and compacted onto and/or into selected portions only of said pallets, said selected portions forming longitudinal strengthening ribs in the finished tile;

c) feeding said pallets with said selected portions covered and/or filled with mortar seriatim beneath said packshaft, roller and slipper whereby, as said process is effected, further mortar is directed onto said pallets and the mortar already compacted on and/or in said selected portions of said pallets to form a cohesive continuous ribbon of mortar on said pallets;

d) cutting said ribbon of mortar to form discrete "green state" tiles on individual pallets; and, e) causing said "green state" tiles to be cured.

There now follows by way of example of the present invention a detailed description of a tile making machine which description is to be read with reference to the accompanying drawings in which FIG. 1 is a schematic side elevation of a twin hopper tile making machine provided by the invention;

In the manufacture of concrete roof tiles by conventional tile processing methods, it has proven difficult if not impossible to ensure the uniform compaction of the layers of mortar throughout the cross-section of the tiles. This is particularly so in the production of tiles with deep reinforcing ribs formed in longitudinal recesses of pallets fed beneath the hopper of a tile making machine.

The present invention thus comprises a unique tile making machine 4 which enables a novel method of making concrete roof tiles 2 to be effected so that all sections of the tiles produced therein are subjected to uniform or substantially uniform compaction forces resulting in a uniformity of mortar density in the finished product which, when cured, has a uniform strength or substantially so.

Figure 1:
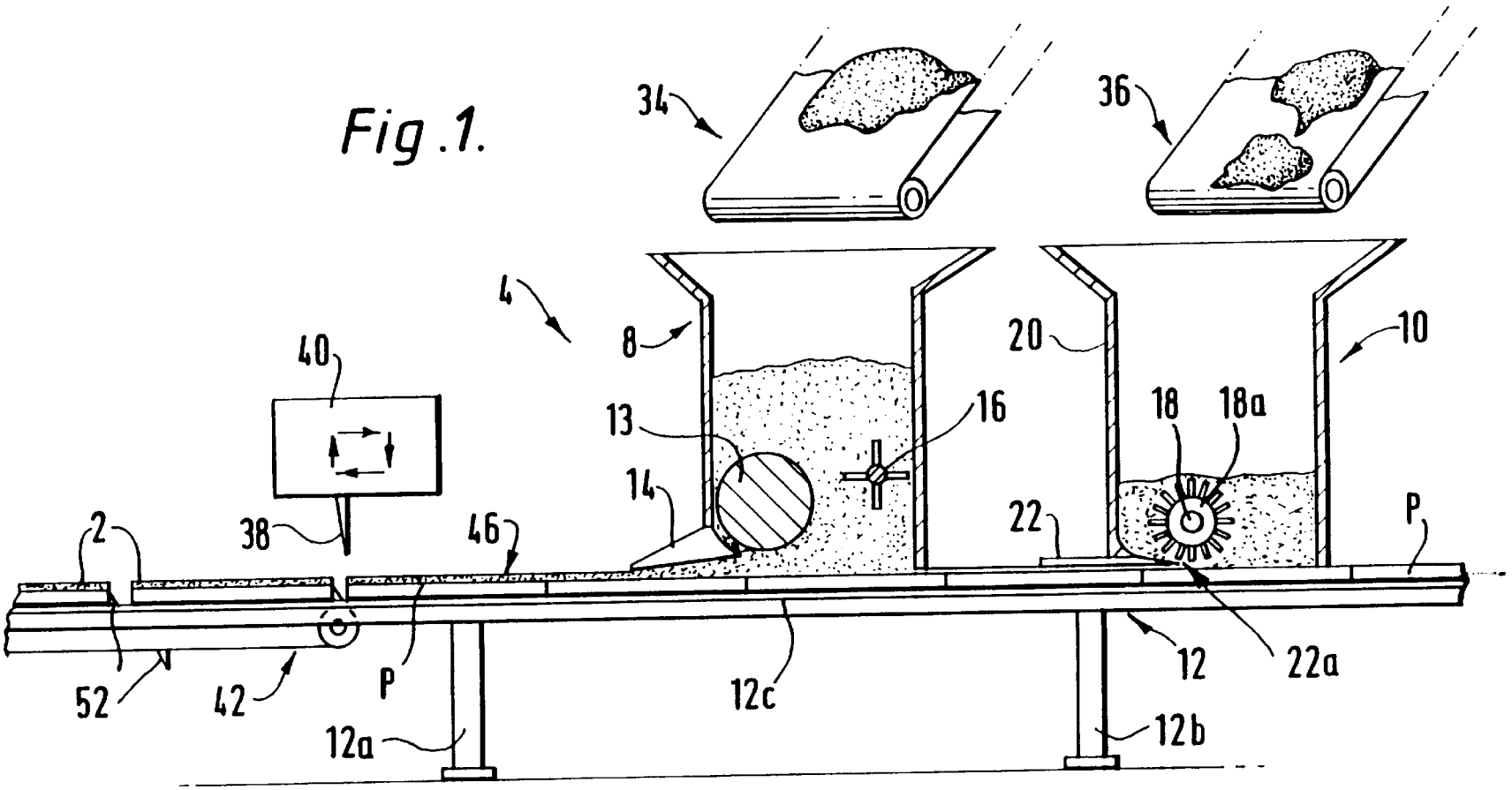

The tile making machine 4, see FIG. 1, comprises twin hoppers 8 and 10 located in series overlying a pallet conveyor 12. The conveyor 12 is of conventional design, is supported on floor mounted columns 12*a* and 12*b* and comprises support rails 12*c* on which pallets P are supported as they pass seriatim beneath the hoppers 8 and 10.

The hopper 8 is also of conventional design and provides support for a roller 13, a slipper 14 and a pack shaft 16. The hopper 10 is located upstream of the hopper 8 and comprises a shaft 18 located towards a front wall 20 thereof. The shaft 18 provides support for a primary compaction device comprised of two tined wheels 18*a* only one of which is shown in the drawings, the purpose of which tined wheels will be made clear hereinafter. The front wall 20 provides support for a secondary compaction device comprised of a blade element 22 the purpose of which element 22 will also be made clear hereinafter.

Located above each hopper 8 and 10 are respective material feed conveyors 34 and 36 for feeding mortar to said hoppers, see FIG. 1.

Downstream of the hopper 8, the tile making machine is provided with a conventional tile cutting knife 38 which is mounted for reciprocal vertical and longitudinal movement on a knife carriage 40 illustrated schematically in FIG. 1.

The tile making machine also comprises a pallet spacing conveyor 42 which is arranged beneath the conveyor 12 and adjacent the knife carriage 40 for a purpose also to be made clear hereinafter.

When the machine of FIG. 1 is in use in the manufacture of concrete roofing tiles, two batches of mortar are fed by the conveyors 34 and 36 to the hoppers 8 and 10 respectively. At the same time, pallets P are fed seriatim along the support rails 12*c* of the conveyor 12 so that mortar in hopper 10 is compacted by the tined wheels 18*a* into upwardly facing longitudinal recesses 19 of the pallets P, see FIG. 5 in which only one such recess 19 is shown.

Figure 5:
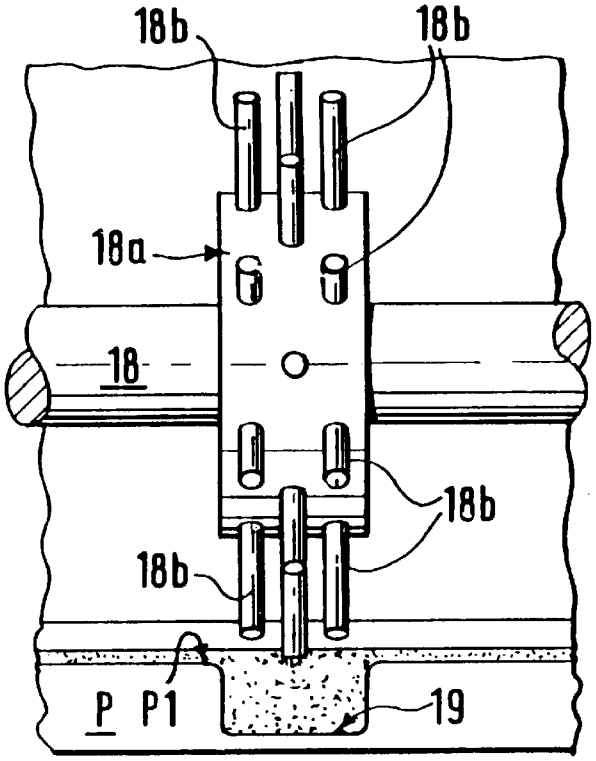
FIG. 5 is a view in the direction of arrow V in FIG. 4.

The recesses 19 enable the formation of the strengthening ribs of a roof tile and, as can be seen in FIG. 5, the tined wheels 18*a* each overlie a respective one of the recesses 19, the wheels 18*a* each providing support for an array of tines 18*b* in three equi-spaced seried ranks around the circumference of the wheel 18*a*.

Figure 4:
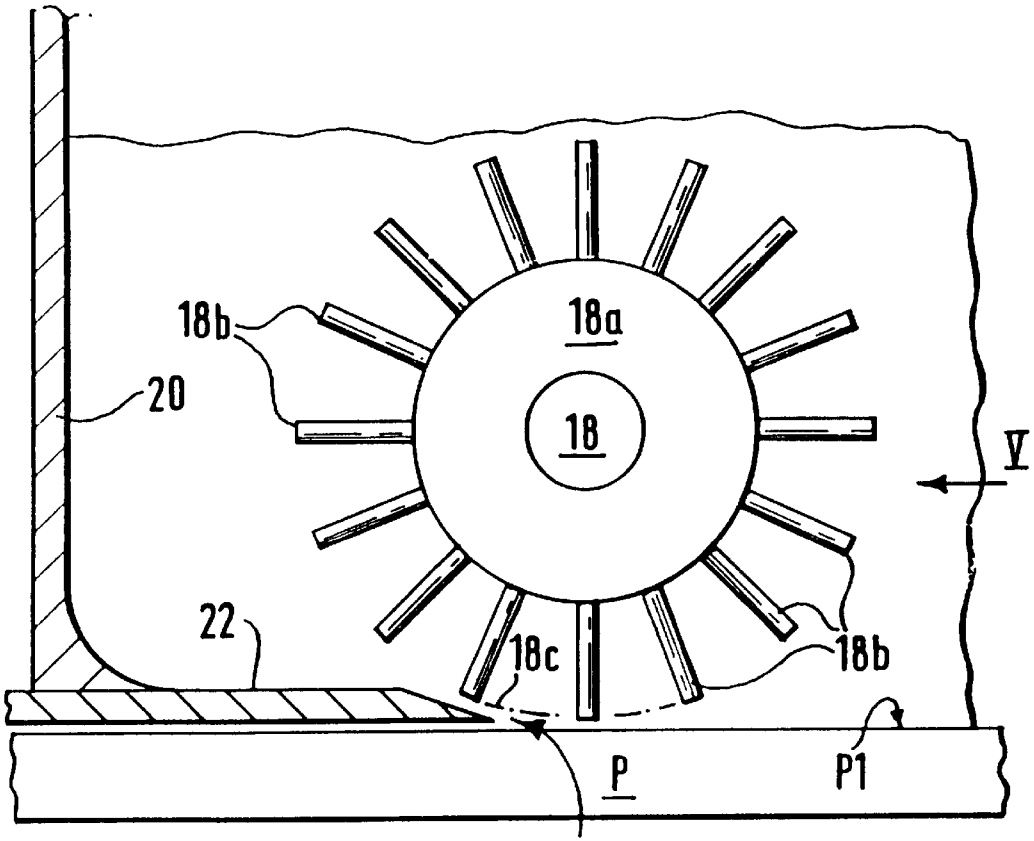
FIG. 4 is an enlarged view of parts shown in FIG. 1.

When the machine is in use and as the pallets P move underneath the hopper 10 as aforesaid, mortar in the hopper 10 is constrained to flow into the recesses 19 and is partially compacted therein by the tines 18*b* of the wheels 18*a*. Subsequently, as the pallets P are carried downstream of the wheels 18*a*, they pass beneath the blade element 22 which extends downstream from a nip portion 22*a* formed between a circumferential path 18*c* generated by the rotating tines 18*b* of the wheels 18a and an upper surface P1 of the pallets P, see FIG. 4.

The blade element 22 which is between 0.1 and 0.3 the length of a tile pallet P acts in part as a conventional slipper and further compacts the mortar into the recesses 19 to facilitate the manufacture of concrete roof tiles with reinforcing ribs which are fit for purpose.

It has been found that the best results are obtained if the hopper 10 is only partially filled with mortar as shown in FIG. 1.

The pallets P thereafter proceed beneath the hopper 8 whereat the mortar therein is compacted by the packshaft 16, the roller 13 and the slipper 14 onto the pallets P and the pre-formed reinforcing ribs to form a ribbon 46 of mortar on the pallets P in known manner.

The ribbon 46 is thereafter cut by the knife 38 of the tile cutting arrangement whereupon trailing ends of the pallets P are engaged by drive elements 52 of the conveyor 42 whereby the "green state" tiles 2 on their associated pallets P are conveyed to racking devices prior to transportation to curing chambers.

Figure 2:
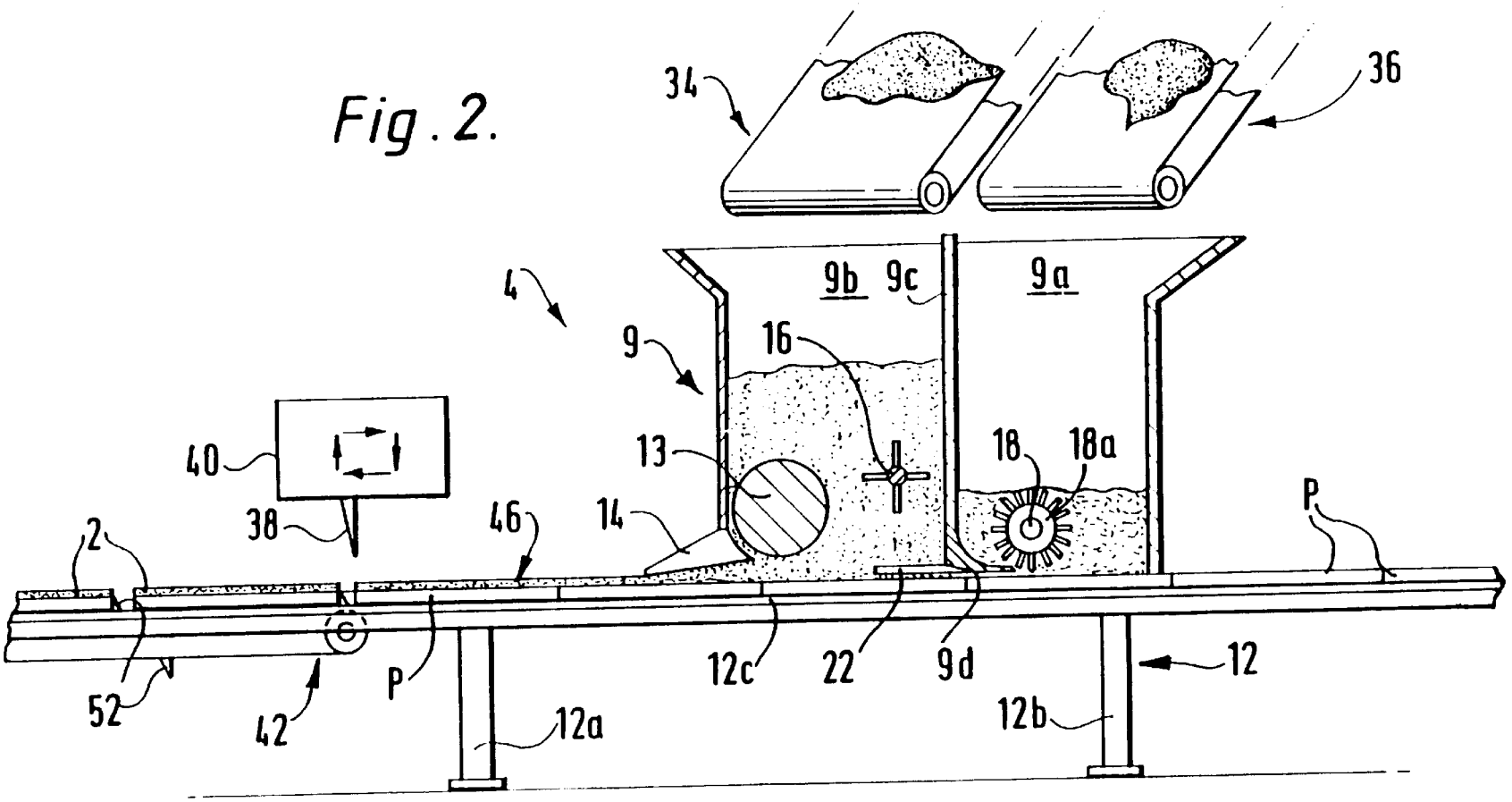
FIG. 2 is a schematic side elevation of a hybrid modification to the hopper arrangement shown in FIG. 1.

Whereas the novel method of making a concrete roof tile remains unaltered, the tile making machine may be modified as shown in FIG. 2 in which the twin hopper arrangement is replaced by a hybrid hopper 9 having first and second sections 9*a* and 9*b* corresponding to hoppers 10 and 8 respectively of FIG. 1. The sections 9*a* and 9*b* are separated by a divider plate 9*c* which supports the blade element 22 at its lower end 9*d*, see FIG. 2. All other features are essentially the same as those of FIG. 1 and they have, therefore, been accorded like reference characters.

Figure 3:
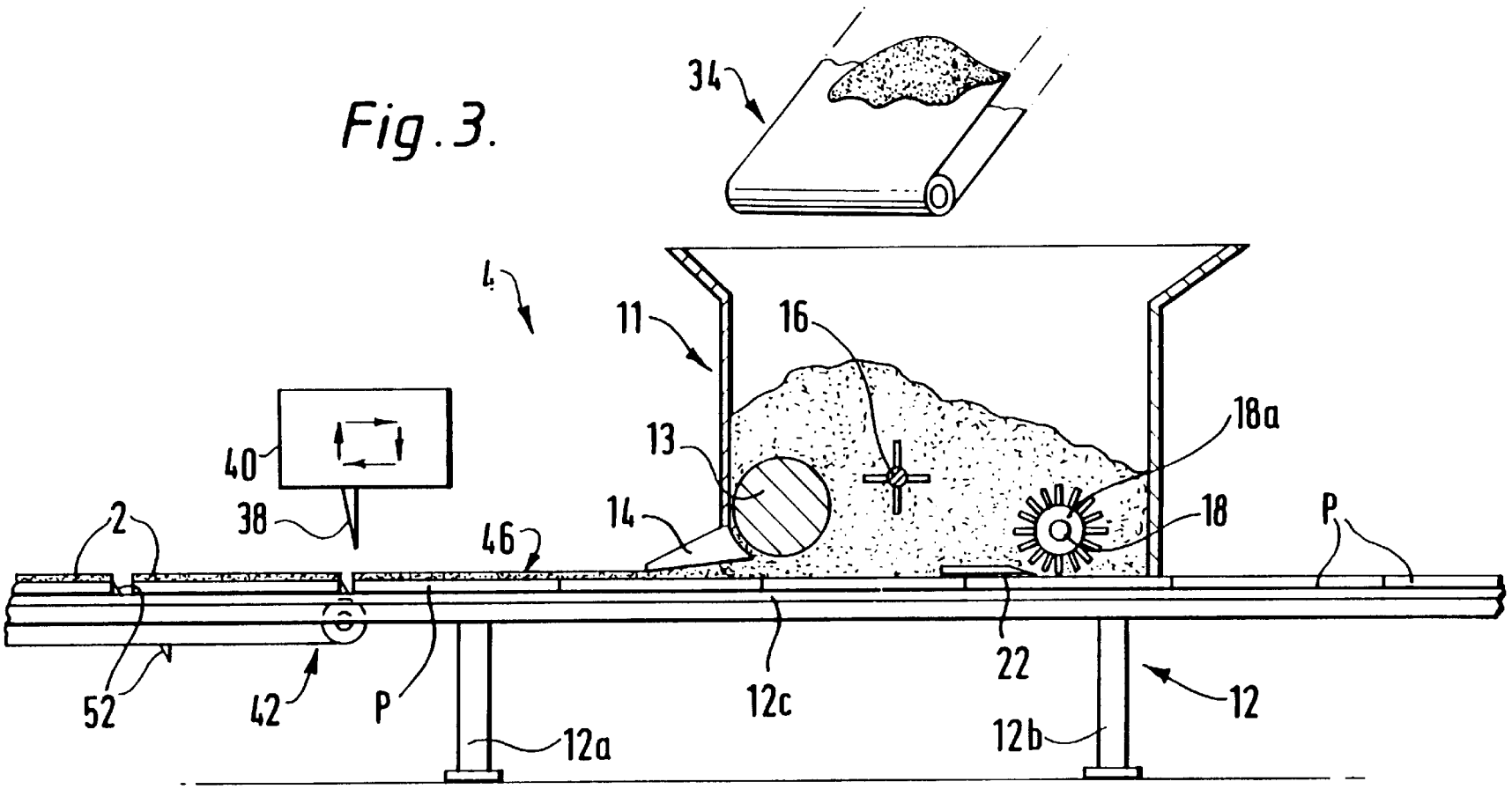
FIG. 3 is a schematic side elevation of a unitary hopper tile making machine.

The tile making machine may also be modified as shown in FIG. 3 in which a unitary hopper 11 comprises support for the roller 13, slipper 14, packshaft 16, tined wheel 18*a* and the blade element 22. As with the first modification, all other features are essentially the same and have, therefore, been accorded like references.

Figure 7:
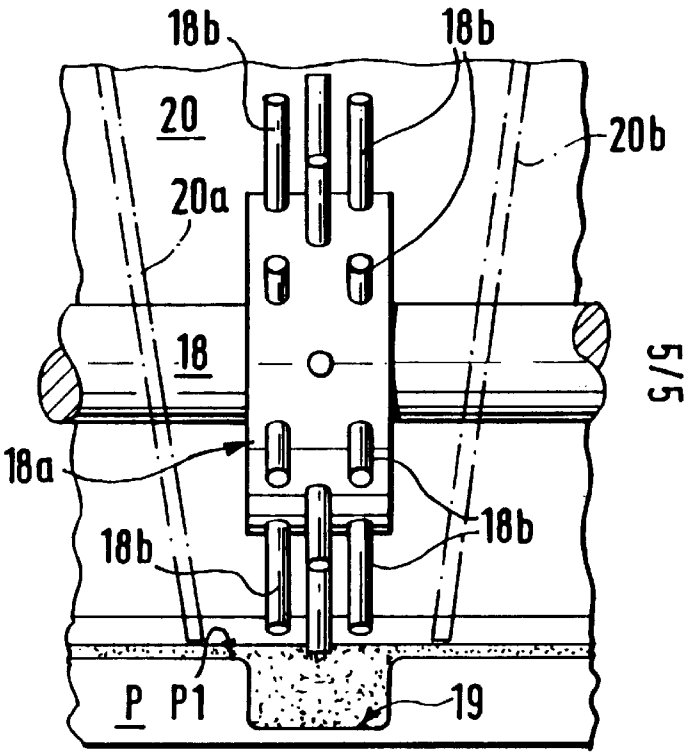
FIGS. 6 and 7 are corresponding views to FIGS. 4 and 5 and illustrate further modifications to the tile making machine.

In a further modified arrangement provided by the invention, see FIG. 7, guide plates 20*a* and 20*b* may be provided on each side of the wheels 18*a* and 18*b* to direct mortar into the recesses 19 of the pallets P.

Figure 6:
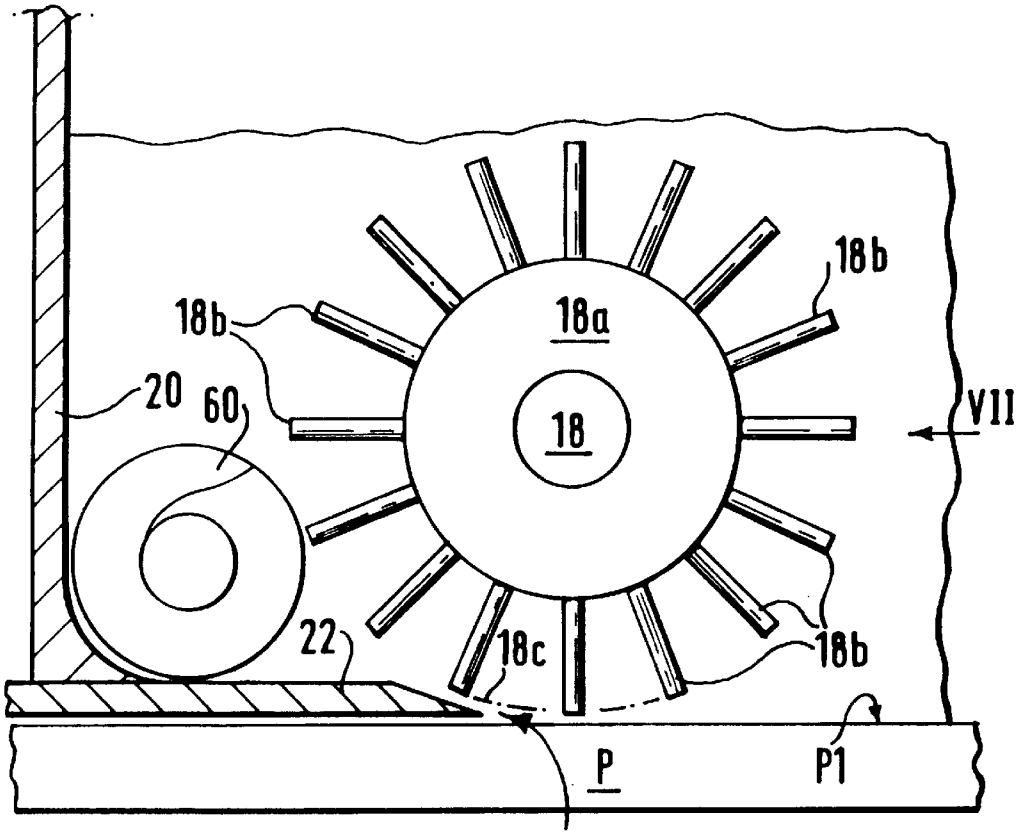

In order to obviate any problems with cavitation of mortar in the hopper 10 of FIG. 1 and to ensure recirculation of mortar, a screw augur 60 may be provided adjacent the wall 20 as shown in FIG. 6 which augur 60 feeds mortar to a collection box (not shown) for recirculation to the top of the hopper 10.

Although not forming part of the present invention, it will be obvious that tiles made using the three modified arrangements of FIGS. 1, 2 and 3 may on the one hand be comprised of different mortars or on the other hand be of the same mortar throughout their thicknesses. In the arrangements of FIGS. 1 and 2, the mortar delivered by conveyor 36 to the hopper 10 or the section 9*a* of the hopper 9 may, if required, be made of different constituents or have varying amounts of the same constituents in areas to assist the compaction of the reinforcing ribs of tiles made therein. The FIG. 3 modification, however, lends itself for use with a single mortar fed by the conveyor 34.

Other modifications may be made within the scope of the invention.

I claim:

1. A tile making machine comprising a hopper provided with a packshaft, roller and slipper, said packshaft being effective to direct mortar onto tile pallets as said pallets pass beneath said roller and slipper of said machine in operation and said pallets fed seriatim beneath said hopper to form a continuous ribbon of mortar on said pallets, said continuous ribbon of mortar cut and cured to form finished tiles, characterized in that said tile making machine also comprises compaction means upstream of said packshaft, roller and slipper, which compaction means comprises a primary compaction device which directs and compacts mortar onto or into, or onto and into, selected portions only of said pallets as said pallets pass beneath said compaction means of said machine in operation, said selected portions forming longitudinal strengthening ribs in said finished tiles.

2. A tile making machine according to claim 1 further characterised in that said compaction means also comprises a secondary compaction device which further compacts said mortar in said selected portions only of said pallets as said pallets pass therebeneath to fully compact said mortar of said selected portions forming said longitudinal strengthening ribs in said finished tiles.

3. A tile making machine according to claim 1 wherein said primary compaction device comprises a multi-tined wheel arranged in use to overlie selected portions only of said pallets.

4. A tile making machine according to claim 3 wherein said multi-tined wheel has an effective width corresponding to a width of said longitudinal strengthening ribs formed by said selected portions only of said pallets.

5. A tile making machine according to claim 2 wherein said secondary compaction device comprises a thin gauge blade clement extending parallel or substantially so to a direction of feed of said pallets fed seriatim beneath said hopper, said blade element comprising a blade portion arranged to lie in or towards a nip portion provided in use of said tile making machine and formed between a circumferential path generated by tines of a multi-tined wheel and co-planar upper surface portions of said pallets fed therebeneath.

6. A tile making machine according to claim 5 wherein said blade element has an effective length of 0.1 to 0.3 of a length of said pallets used therewith.

7. A tile making machine according claim 1 wherein said compaction means is located in said hopper upstream of said packshaft, roller and slipper.

8. A tile making machine according to claims 1 wherein said compaction means is located in a secondary hopper located upstream of said hopper.

9. A tile making machine according to claim 2 wherein said primary compaction device comprises a multi-tined wheel arranged in use to overlie selected portions only of said pallets.

10. A tile making machine according to claim 9 wherein said multi-tined wheel has an effective width corresponding to a width of said longitudinal strengthening ribs formed by said selected portions only of said pallets.

11. A tile making machine according to claim 9 wherein said secondary compaction device comprises a thin gauge blade element extending parallel or substantially so to a direction of feed of said pallets fed seriatim beneath said hopper, said blade element comprising a blade portion arranged to lie in or towards a nip portion provided in use of said tile making machine and formed between a circumferential path generated by tines of said multi-tined wheel and co-planar upper surface portions of said pallets fed therebeneath.

12. A tile making machine according to claim 10 wherein said secondary compaction device comprises a thin gauge blade element extending parallel or substantially so to a direction of feed of said pallets fed seriatim beneath said hopper, said blade element comprising a blade portion arranged to lie in or towards a nip portion provided in use of said tile making machine and formed between a circumferential path generated by tines of said multi-tined wheel and co-planar upper surface portions of said pallets fed therebeneath.

13. A tile making machine according to claim 11 wherein said blade element has an effective length of 0.1 to 0.3 of a length of said pallets used therewith.

14. A tile making machine according to claim 12 wherein said blade element has an effective length of 0.1 to 0.3 of a length of said pallets used therewith.

15. A tile making machine according to claim 2 wherein said compaction means is located in said hopper upstream of said packshaft, roller and slipper, as aforesaid.

16. A tile making machine according to claim 2 wherein said compaction means is located in a secondary hopper located upstream of said hopper.

17. A process for the manufacture of concrete roof tiles using a tile making machine comprising a hopper supporting a packshaft, a roller and a slipper and a compaction means upstream of said hopper, said compaction means comprising a primary compaction device, said process comprising the steps of:

a) supplying mortar to said compacting means located upstream of said packshaft, roller and slipper;

b) causing tile pallets to be fed seriatim beneath said compacting means wherein said supplied mortar is directed and compacted onto or into, or onto and into, selected portions only of said pallets, said selected portions forming longitudinal strengthening ribs in finished tiles;

c) feeding said pallets with said selected portions covered or filled, or covered and filled, with said mortar seriatim beneath said packshaft, roller and slipper wherein further mortar is directed onto said pallets and onto said mortar already compacted on or in, or on and in, said selected portions of said pallets to form a cohesive continuous ribbon of mortar including said longitudinal strengthening ribs on said pallets, d) cutting said ribbon of mortar to form discrete green state tiles on said pallets, said tiles having said longitudinal strengthening ribs; and e) causing said green state tiles having said longitudinal strengthening ribs to be cured into finished tiles.

* * * * *